United States Patent [19]

Scott

[11] Patent Number: 4,842,151

[45] Date of Patent: Jun. 27, 1989

[54] PRESSURIZING CLOSURE APPARATUS FOR A CARBONATED BEVERAGE BOTTLE

[76] Inventor: Stephen T. Scott, 9030 Jamacha Blvd., Spring Valley, Calif. 92077

[21] Appl. No.: 223,940

[22] Filed: Jul. 25, 1988

[51] Int. Cl.[4] ..... B65D 51/24

[52] U.S. Cl. ..... 215/228

[58] Field of Search ..... 215/228, 260, 359

[56] References Cited

U.S. PATENT DOCUMENTS

| | | | |
|---|---|---|---|
| 875,397 | 12/1907 | Willis | 215/359 |
| 1,212,871 | 1/1917 | Abbott | 215/359 |
| 2,822,103 | 2/1958 | Moeller | 215/359 |
| 4,033,091 | 7/1977 | Saponara | 215/228 X |
| 4,051,971 | 10/1977 | Saleri et al. | 215/228 |
| 4,524,877 | 6/1985 | Saxby et al. | 215/228 |
| 4,640,426 | 2/1987 | Wasley | 215/228 |
| 4,763,803 | 8/1988 | Schneider | 215/228 |

FOREIGN PATENT DOCUMENTS

| | | | |
|---|---|---|---|
| 2452436 | 11/1980 | France | 215/359 |

*Primary Examiner*—Donald F. Norton

*Attorney, Agent, or Firm*—Charles C. Logan, II

[57] ABSTRACT

The pressurizing closure apparatus for a carbonated beverage bottle has a closure plug assembly, a female quick disconnect coupling, and an air pumping unit. The closure plug assembly has a pressure seal plug whose diameter can be increased to seal the neck of a bottle by actuating a cam lever that is pivotally mounted on the top of the closure plug assembly. The one-way valve unit is mounted in the top cap portion of the closure plug assembly and its bottom end is in communication with an air passage tube whose bottom end has an outlet port in the interior of the bottle. The female quick disconnect coupling has its one end connected to the one-way valve unit and it other end connected to the air pumping unit. Actuation of the air pumping unit will introduce air into the sealed bottle to repressurize its interior.

4 Claims, 1 Drawing Sheet

PRESSURIZING CLOSURE APPARATUS FOR A CARBONATED BEVERAGE BOTTLE

BACKGROUND OF THE INVENTION

The invention relates to a closure plug for a bottle and more specifically to one having structure which allows the interior of the bottle to be repressurized in order to maintain the carbonization of a beverage therein.

Whenever a person opens a beverage which has internal gases or carbonation, those gases begin to escape into the atmosphere. This is the case with soda pop, carbonated drinks or water, bear, and champagne. Should a person not consume all of a beverage from a bottle and wish to store the remainder, freshness becomes a problem. As soon as the bottle is recapped, the gases inside the liquid begin to equalize pressure with the ambient air in the bottle above the liquid level. Pressure equalization continues until the pressure in the bottle reaches a level where molecules of gas attempting to escape are held in by the pressure of the air above the liquid level. At that point the gas stops escaping from the liquid and it becomes stable. The problem is that during the pressure equalization process, the natural fizz that makes the beverage desirable is reduced or lost. While common bottle stoppers seal adequately, they do nothing to prevent the escape of the efforvescence of the drink. When a bottle is large or if liquid level to air space ratio is favorable, the amount of gas which escapes the beverage before natural pressure equalization is reached can be enough to leave the beverage "flat" and undesirable for further consumption. With expensive champagne, any loss of gas can have a negative effect on the taste and value of the drink. Recapping a bottle is often out of the question if quality of the champagne is a concern, regardless of the amount withdrawn prior to the sealing.

Applicant's novel apparatus provides a means of pressure equalization. Beverages such as soda pop, carbonated water, beer and champagne can be opened, a small amount consumed, and then resealed and repressurized without loss of the original taste and efforvescence. For those in the restaurant business the ability to reseal and repressurize expensive champagne would offer a means to save the product and save money. In private use the apparatus provides structure and a way to save money by preserving the flavor and freshness of all types of beverages. The apparatus allows its user to save beverages from open bottles without loss of efforvescence and thus saves the original flavor and eliminates the cost of pouring out "flat drinks".

SUMMARY OF THE INVENTION

Applicant's novel pressurizing closure apparatus for a carbonated beverage bottle has been designed to permit the pressurized resealing of liquid beverages in a bottle so as to preserve and maintain the efforvescence as nearly as possible to the original, unopened beverage. The apparatus consists of a closure plug assembly which is cam operated to seal the top or mouth of the bottle. The pressure seal plug of the closure plug assembly expands radially with the operation or movement of the cam lever in such a manner so as to create a leak proof, pressure retaining seal when in place in the mouth of the bottle. A one-way air valve unit is mounted in the top cap portion of the closure plug assembly adjacent the cam lever. The purpose of the one-way valve unit is to permit the introduction of air into the bottle after the seal is made. By introducing air into the sealed bottle, the air pressure is increased inside the bottle. With the inner bottle pressurized, the internal gasses of the liquid being stored in the bottle will not escape, thus preserving the freshness and efforvescence of the beverage.

The pressurizing closure apparatus also has a female quick disconnect coupling whose one end is connected to the one-way valve unit and whose opposite end is connected to an air pumping unit. The air pumping unit is constructed with a valve on each end to permit air flow in one direction only and is an enlarged palm sized rubber squeeze bellow pump. The pump is also equipped with a pressure indicator which will indicate the pressure being attained while pumping. When the desired pressure level is reached, (depending upon the type of beverage being pressurized), the pumping action can be stopped, and the female quick disconnect coupling closure assembly in the bottle may be removed and stored for later use.

DESCRIPTION OF THE PREFERRED EMBODIMENT

Figure 1:
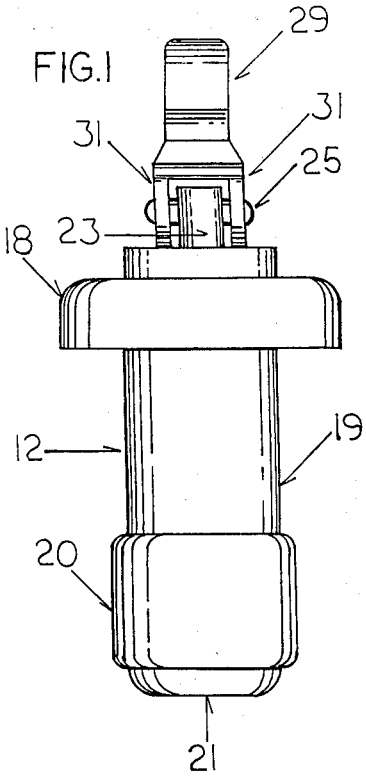
FIG. 1 is a side elevation view of applicant's novel closure plug assembly.
Figure 2:
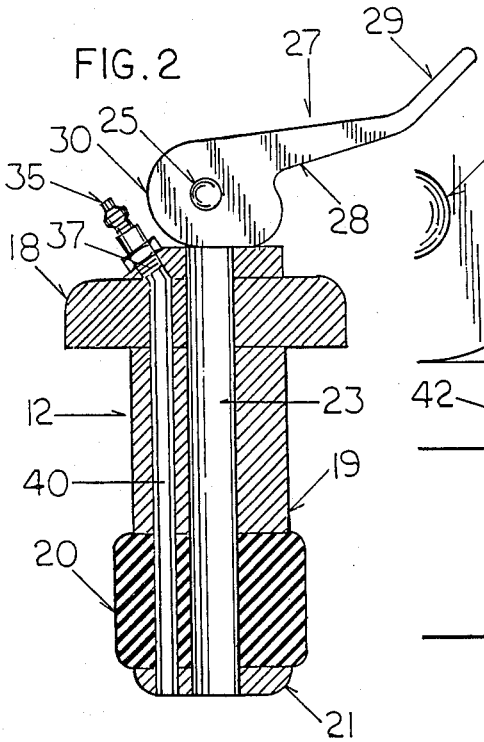
FIG. 2 is a partial cross-sectional view of the closure plug assembly after it has been rotated ninety degrees to the view in FIG. 1.

Applicant's novel pressurizing closure apparatus for a carbonated beverage bottle will now be described by referring to FIGS. 1–5 of the drawing. The pressurized closure apparatus is generally designated numeral 10. Its basic components are closure plug assembly 12, female quick disconnect coupling 14 and air pumping unit 16.

Closure plug assembly 12 has a top cap 18, a shank portion 19, a rubber pressure seal plug 20, and a compression cap 21, A shaft 23 extends downwardly through aligned apertures in the aforementioned components and it has its bottom end secured to compression cap 21 and its top end has a pin 25 extending laterally therethrough. A cam lever 27 has a shank portion 28, a leg portion 29 and a head portion 30. Head portion 30 has bifurcated legs 31 with apertures therein that receive the opposite ends of pin 25. Rotational movement of cam lever 27 downwardly around pin 25 causes the pressure seal plug 20 to be compressed and therefore expand laterally to form a fluid tight seal in the interior of the bottle neck. A one-way valve unit 35 has its bottom end threaded into internally threaded recess 37 formed in the top of cap 18. An air passage tube 40 passes downwardly through closure plug assembly 12 with its top end in communication with one-way valve unit 35 and its bottom end would be open to the interior of a bottle.

Figure 3:
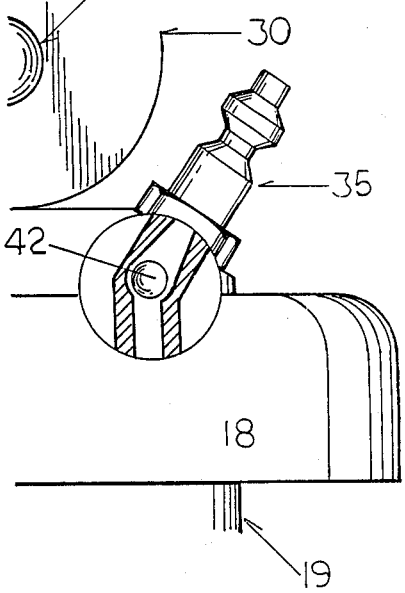
FIG. 3 is an enlarged partial view of the closure plug assembly with portions broken away.
Figure 4:
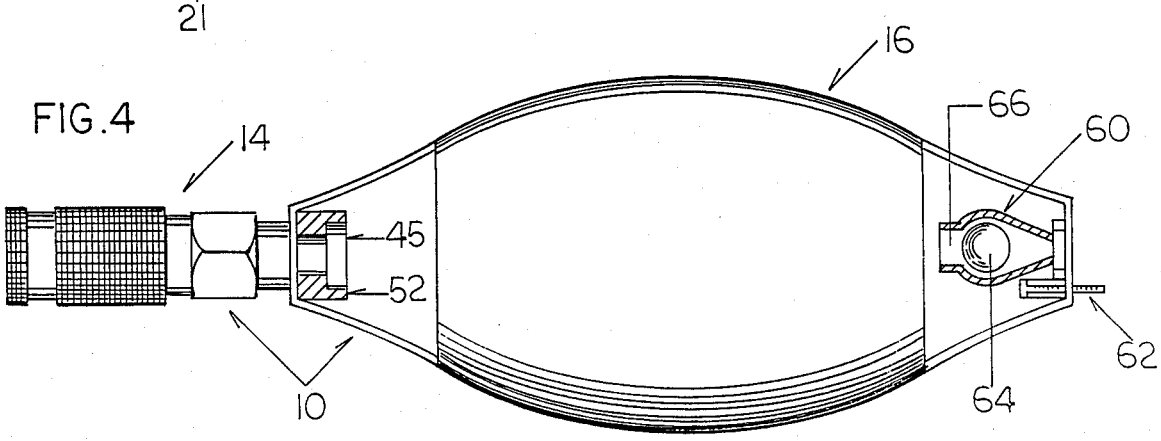
FIG. 4 is a side view of the female quick disconnect coupling and air pumping unit with portions broken away.
Figure 5A:
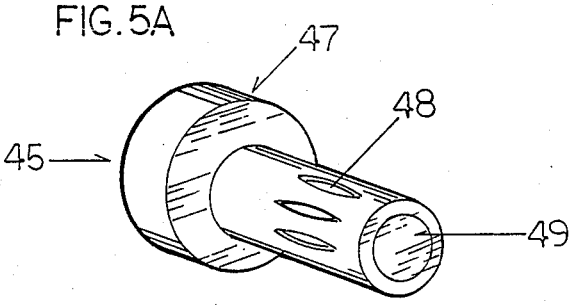
FIG. 5*a* is a rear perspective view of the valve in the front end of the air pumping unit.
Figure 5B:
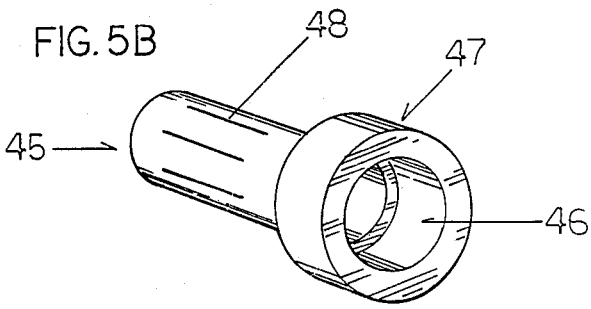
FIG. 5*b* is a front perspective view of the valve in the front end of the air pumping unit.

One-way valve unit 35 is illustrated in cross section in FIG. 3 where it is shown that it has a ball valve 42 that functions in a conventional manner. The top end of one-way valve unit 35 is detachably received in the female end of quick disconnect coupling 14. The opposite end of coupling 14 has a male connector portion that is received in a female connector portion of air pumping unit 16. This end has a one-way valve 45. Air passes inwarldy through opening 46 in enlarged portion 47 until it reaches the plugged end 49. Pressure then causes the air to pass through enlarged slitted openings 48 and ultimately into the bottle. Upon releasing compression of the bellows, air can not pass backward because the slits 48 in the one-way valve 45 collapse prohibiting escape of air. One-way air valve 45 has its enlarged end 47 fiting tightly into valve housing 52 which further prohibits backward release of air pressure into the bellows. At the other end of bellows air pump unit 16, a one-way valve unit 60 is mounted for allowing air to be sucked into the pump. An air pressure indicator gage 62 also extends from that end of the pump. Valve 60 also has a ball valve 64 and it functions the same as one-way valve unit 35.

In operation air passes into bellows air pumping unit 16 through opening 66 when the bellows expands. The inwardly traveling air pushes ball valve 64 inwardly to the bottom of the ball chamber to a position where the inwardly flowing air passes by ball valve 64 and fills bellows 16. Upon compression of the bellows 16, the air pressure forces ball valve 64 toward the outward end of the ball chamber where a seal is made due to the tight fit of ball valve 64. As the pumping action continues, air pressure in the bottle and in the system increases. Pressure indicator 62 is a common air pressure gage which is actuated by air pressure and extends outwardly giving a reading or indication of pressure attained in the system. The user of the device will cease pumping when the pressure indicator 62 indicates a sufficient pressure is reached in the system to prevent gases from escaping from the liquid being stored in the bottle.

What is claimed is:

1. A pressurizing closure apparatus for closing the opening in a bottle that contains a carbonated beverage or the like comprising in combination:

a closure plug assembly for removable engagement in the opening of said bottle comprising an elongated cylindrically shaped shank portion having a top end and a bottom end, a top cap portion connected to the top end of said shank portion, a cylindrically shaped pressure seal plug located adjacent the bottom end of said shank portion, a compression cap located adjacent the bottom end of said pressure seal plug, an elongated shaft passing vertically through aligned apertures in said top cap portion, said shank portion and said pressure seal plug, the bottom end of said shaft fixedly captured by said compression cap, the top end of said shift having a pin passing laterally therethrough, cam lever means pivotally connected to said pin for laterally expanding said pressure seal plug in the opening in said bottle, a one-way valve unit having a top end and a bottom end, the bottom end of said one-way valve unit being removably received in a recess formed in the top surface of said top can portion, air passage means connecting the bottom end of said one-way valve unit with the bottom end of said compression cap;

a female quick disconnect coupling having a first female end detachably connected to the one-way valve unit of said closure plug assembly; and an air pumping unit having a first end and a second end, said first end being detachably connected to one end of said female quick disconnect coupling.

2. A pressurizing closure apparatus as recited in claim 1 wherein said cam lever means comprises a cam lever having a shank portion, a head portion and a leg portion, said head portion being formed from camshaped bifurcated legs.

3. A pressurizing closure apparatus as recited in claim 1 wherein said air pumping unit has an air pressure indicator gage mounted in its second end.

4. A pressurizing closure apparatus as recited in claim 1 wherein said air pumping unit has a bulbous shaped bellows portion.

* * * * *